US006907730B2

(12) United States Patent
Kiikka

(10) Patent No.: US 6,907,730 B2
(45) Date of Patent: Jun. 21, 2005

(54) DISPLACER AND SEAL ASSEMBLY FOR STIRLING CYCLE MACHINES

(75) Inventor: Dale Evan Kiikka, Athens, OH (US)

(73) Assignee: Global Cooling BV, Armhem (NL)

( * ) Notice: Subject to any disclaimer, the term of this patent is extended or adjusted under 35 U.S.C. 154(b) by 77 days.

(21) Appl. No.: 10/474,405

(22) PCT Filed: Jun. 17, 2002

(86) PCT No.: PCT/US02/19036

§ 371 (c)(1),
(2), (4) Date: Oct. 8, 2003

(87) PCT Pub. No.: WO03/001871

PCT Pub. Date: Jan. 9, 2003

(65) Prior Publication Data

US 2004/0129133 A1 Jul. 8, 2004

(30) Foreign Application Priority Data

Jun. 28, 2001 (JP) ..... 2001-196692

(51) Int. Cl.[7] ..... F02G 1/04
(52) U.S. Cl. ..... 60/517; 60/520
(58) Field of Search ..... 60/517, 520, 526

(56) References Cited

U.S. PATENT DOCUMENTS 4,714,008 A 12/1987 Bowers
4,736,586 A * 4/1988 Kawajiri et al. ..... 60/517
4,885,017 A * 12/1989 Fleischmann ..... 62/6
5,099,650 A * 3/1992 Crunkleton ..... 62/6
5,113,747 A 5/1992 Pignerol
5,642,618 A 7/1997 Penswick
5,765,377 A * 6/1998 Kim ..... 62/6
5,918,463 A * 7/1999 Penswick et al. ..... 60/517

* cited by examiner

*Primary Examiner*—Hoang Nguyen
(74) *Attorney, Agent, or Firm*—Frank H. Foster; Kremblas, Foster, Phillips & Pollick

(57) ABSTRACT

The invention can prevent gas leakage and reduce friction force while relaxing tolerance for manufacturing a displacer and the like for Stirling cycle machines. Gas leakage between the outer periphery of a seal (1) and the inner peripheral surface (5*a*) of a cylinder (5) is prevented. Accordingly, precise finish of the radial clearance between the displacer (2) and the cylinder (5) is not required. As the difference of pressures between the front and rear spaces of the displacer (2) is small, the gas leakage is sufficiently prevented without pressing the seal (1) against the inner peripheral surface (5*a*) of the cylinder (5). On the other hand, as the friction force generated between them is significantly small, it does not affect the reciprocation of the displacer. As the seal (1) is provided so as not to be restricted axially and radially, the displacer is kept closely contacted with the inner peripheral surface (5*a*) of the cylinder (5) even if the displacer (2) eccentrically shifts.

2 Claims, 4 Drawing Sheets

DISPLACER AND SEAL ASSEMBLY FOR STIRLING CYCLE MACHINES

BACKGROUND OF THE INVENTION

The present invention relates to a displacer and seal assembly for Stirling cycle machines, which prevents gas leakage and reduces friction force while relieving manufacturing accuracy of the displacer, cylinder and the like.

DESCRIPTION OF THE RELATED ART

Conventionally, so-called beta configuration has been employed as one of the configurations of Stirling cycle machines, in which a displacer and a power piston are arranged co-axially within a same cylinder. In this configuration, the radial clearances between the cylinder bore and moving parts such as piston, rod and the like have to be very small (around 0.025 mm) so as to obtain high operating performance and adequately prevent gas leakage. Those small clearances require a severe control of tolerance for concentricity, straightness and clearances for the moving parts such as displacer, power piston, or cylinder. However, such requirements bring about increases in manufacturing cost and needs to use expensive materials which would not dimensionally change during their applications.

As means for relaxing the tight tolerance, split rings is supposed to be used, which has been conventionally used for pistons in the internal combustion engines and the like. The split rings are designed so as to apply a uniform radial pressure to the cylinder bore by its own spring forces. In another means, a seal is designed to closely contact with the bore surface of the cylinder by the pressure of the working gas. Those means are aimed to securely prevent leakage of highly pressurized gas that is produced during the compressing and burning process in internal combustion engines and the like.

However, those split rings as a seal for the displacer of Stirling cycle machines is difficult to adopt. Because the split rings or the like bear against the cylinder bore surface and slide therein, they need lubricant to restrict friction force and heat generation. However, using lubricant for the displacer is structurally difficult. Further, the friction force generated by the contact of the split ring with the cylinder bore without lubricant deteriorates proper operations of the displacer. Namely, the displacer operates by a small amount of forces generated by a slight difference of pressures applied on its pressured areas as described later, the friction force causes a great resistance force against the operation of the displacer. Accordingly, in the design of the displacer, proper technical means should be adopted to restrict pressure contact forces and friction losses as well as to relieve the tight tolerances and manufacturing accuracy.

SUMMARY OF THE INVENTION

Accordingly, an object of the present invention is to provide a displacer and seal assembly for Stirling cycle machines, which reduces manufacturing cost by relaxing manufacturing tolerance and dimensional accuracy of the parts, elongates durability, simplifies the structure with less parts required, and is assembled easily and quickly.

A displacer and seal assembly for Stirling cycle machines provided in the first aspect of the present invention is comprised of a displacer, a power piston, a cylinder, a seal, and a retaining ring. The displacer and the power piston are structured so as to reciprocate with each other in a phase relationship along the inner peripheral surfaces of a cylinder bore formed concentrically with the cylinder. The displacer comprises a cylindrical body portion, and a step (2*b*) and a rod (4), both of which are provided concentrically with the body portion.

The outer periphery of the body portion has a diameter to be inserted into the inner peripheral surface of the cylinder with a predetermined radial clearance. The step is integrally disposed on one end of the body portion and has a diameter smaller than the outer periphery of the body portion. A side surface, which connects the outer periphery of the step to the outer peripheral end of the body portion, is formed perpendicularly to the axial direction. The rod is integrally disposed on one end of the step and has a circular cross sectional shape.

The seal is formed in a ring shape and has a circular hole in the center thereof. The outer periphery of the seal has a diameter to be closely inserted into the inner peripheral surface of the cylinder. The inner periphery of the circular hole in the seal has a diameter to be attached to the outer periphery of the step with a predetermined radial clearance. The retaining ring is formed in a cylindrical shape and has a through hole in the center thereof. The outer periphery of the retaining ring is formed so as to have the same diameter as the outer periphery of the body portion. One end surface of the retaining ring is formed perpendicularly to the axial direction.

The rod passes through a center hole that is formed in the center of the power piston and is radially supported by a hearing seal that is provided in the center hole. The seal is inserted on the outer periphery of said step (2*b*). The retaining ring is installed in a position at which no axial pressure is applied to the seal that is inserted on the step. The seal is structured such as to freely move in the radial direction thereof between the one end surface of the retaining ring (3) and the side surface of the step.

Next, an explanation will be given as to the function and effect of the displacer and seal assembly for the Stirling cycle machines mentioned above. The seal is inserted on the outer periphery of the step by being held between the respective side surfaces of the step and the retaining ring that are perpendicular to the center axis. However, the seal is arranged so as not to receive axial compression force. Namely, the axial gap between the respective side surfaces of the step and the retaining ring is slightly wider than the width of the seal. Accordingly, the seal is pressed to either the side surface of the step or that of the retaining ring due to a slight difference of gas pressures applied to the either end of the seal. Consequently, gas leakage from between the side surface of the seal and the side surface of either the step or the retaining ring is prevented.

Further, the diameter of the circular hole in the seal is larger than that of the outer periphery of the step. Accordingly, while the seal is inserted into the outer periphery of the step, it moves radially. On the other hand, the outer periphery of the seal is formed in such a shape that the seal can be closely inserted into the inner periphery of the cylinder. Accordingly, the close contact between the outer periphery of the seal and the inner periphery of the cylinder is maintained by the radial movement of the seal. Therefore, gas leakage is prevented even if the clearance, straightness, and concentricity between the outer periphery of the displacer and the inner periphery of the cylinder is not so severely controlled.

The seal applies no radial pressure to the inner surface of the cylinder, as it does not have any slit in its circumference, which is disposed in the conventional split ring or the like. On the other hand, in the Stirling cycle machines, difference of the pressures between in the front space of the displacer and in the rear space thereof, which is generated by the reciprocating motion of the displacer, is significantly small. Accordingly, if a seal capable of closely inserted into the inner peripheral surface of the cylinder is used, gas leakage is sufficiently prevented without applying radial pressure as the seal positively contacts with the inner surface of the cylinder. Further, as radial pressure is not applied to the cylinder, the friction force between the cylinder and the seal is significantly small, thereby influences on the operation of the displacer can be minimum, and wearing is prevented. Further, as gas leakage is sufficiently prevented by using this seal, it is no longer necessary to finish a sliding surface with high accuracy in order to minimize the radial clearance between the cylinder and the displacer.

The seal relieves tight tolerances for the concentricity of the outer peripheral sliding surface of the displacer and the outer diameter of the rod. That is, the displacer is radially positioned by the rod that is supported by the bearing seal provided in the through hole of the power piston. However, as the seal radially moves on the step provided in the displacer, the concentricity between the outer peripheral sliding surface of the displacer and the outer diameter of the rod is no more important.

The present invention may be applied to the Stirling cycle machines either used as an external combustion engine or as a refrigerator using exterior power source. When the seal is used in the external combustion engine, heat resistance material such as metal or the like should be selected, while synthetic resin such as plastic or the like may be additionally used when the seal is used in the refrigerator. Further, means for axially mounting the retaining ring to the step preferably employs screwing, however, it may include other means such as a spring clip, snap fit, brazing or the like.

In accordance with the second aspect of the present invention, there is provided a displacer and seal assembly for Stirling cycle machines as recited in the first aspect, wherein the outer periphery of the seal is formed so as to have an axially parallel portion in the center of axial length of the seal and so as to have axially slope portions in which the radius gradually decreases from the either edge of the parallel portion toward the either side surface of the seal, to form wedge-shaped spaces between the respective axially slope portions and the inner peripheral surface of the cylinder.

In the second aspect of the present invention, the shape of the seal, which is formed so that the diameter thereof becomes smaller from both edges of the parallel portion thereof toward either side surface thereof, does not refer to a shape that has either chamfers or cornering Rs at the either end of the outer periphery thereof, but refers to one that forms, together with the inner peripheral surface of the cylinder, a wedge-shaped space with a small angle.

In accordance with the second aspect of the present invention, the friction force between the seal and the cylinder can be reduced. Namely, as the seal is formed in a continuous ring without a slit, the outer periphery of the seal is not pressed against the cylinder bore surface. On the other hand, as the pressure difference between the front and the rear spaces of the displacer is small, gas leakage is sufficiently prevented without the seal being pressed.

If the both ends of the outer periphery of the seal is formed in such a shape to form the wedge-shaped space together with the inner peripheral surface of the cylinder, air or gas is pressed into the wedge-shaped space by the high-speed reciprocating motion of the displacer and is compressed in the clearance between the outer periphery of the seal and the inner periphery of the cylinder. Accordingly, as the seal reciprocates, it floats from the inner periphery of the cylinder due to an air-cushion function of the compressed air and the mechanical contact between the sliding surfaces is avoided. By which, the friction force decreases to almost zero, and the frictional wear of the sliding surfaces is further reduced.

DESCRIPTION OF THE PREFERRED EMBODIMENTS

Figure 1:
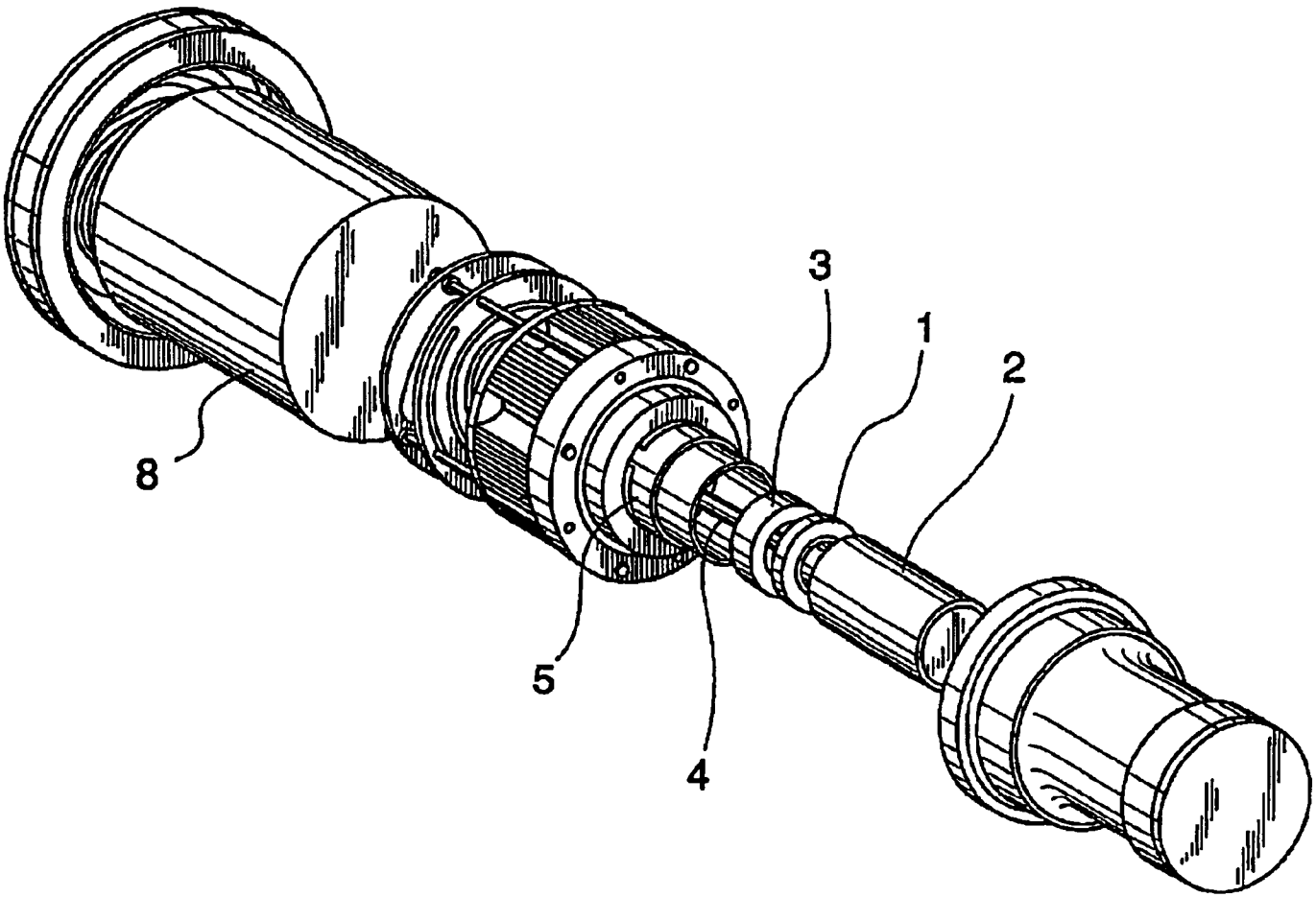
FIG. 1 is a perspective view of a structure of a displacer and seal assembly for Stirling cycle machines.
Figure 2:
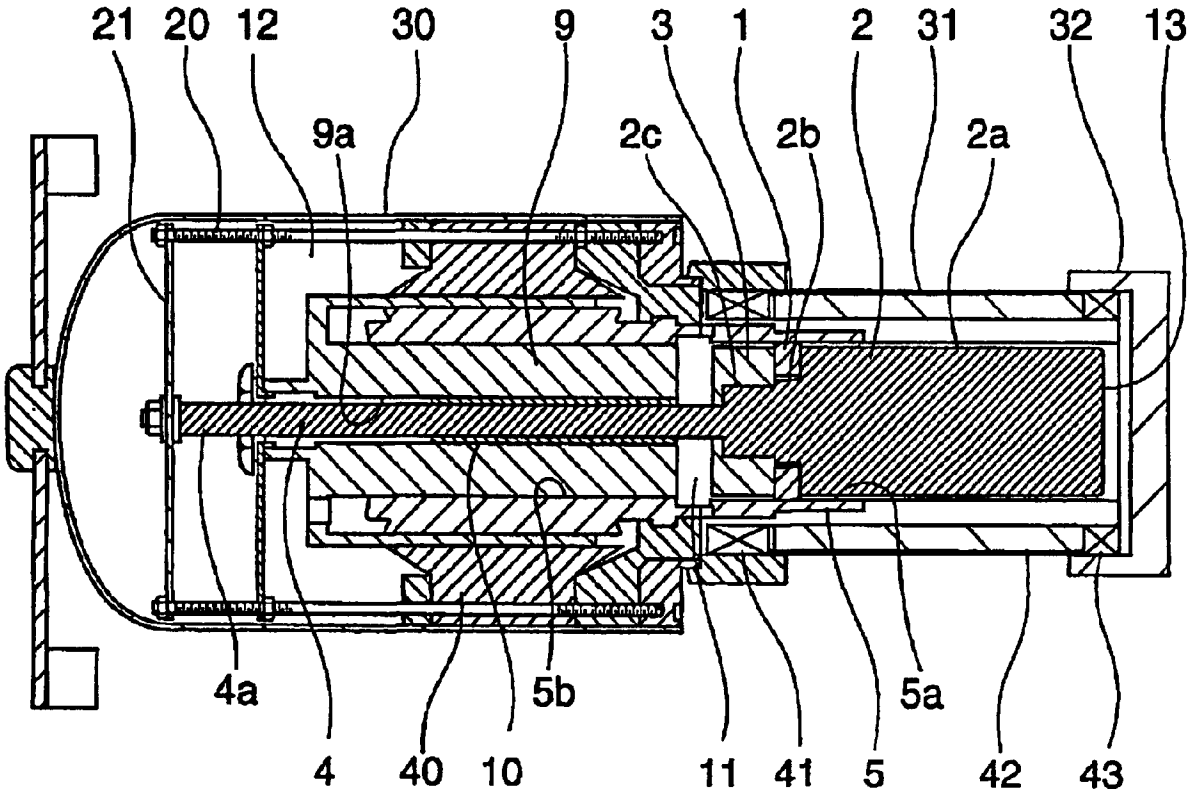
FIG. 2 is a cross sectional view of the structure of the displacer and seal assembly for Stirling cycle machines.
Figure 3:
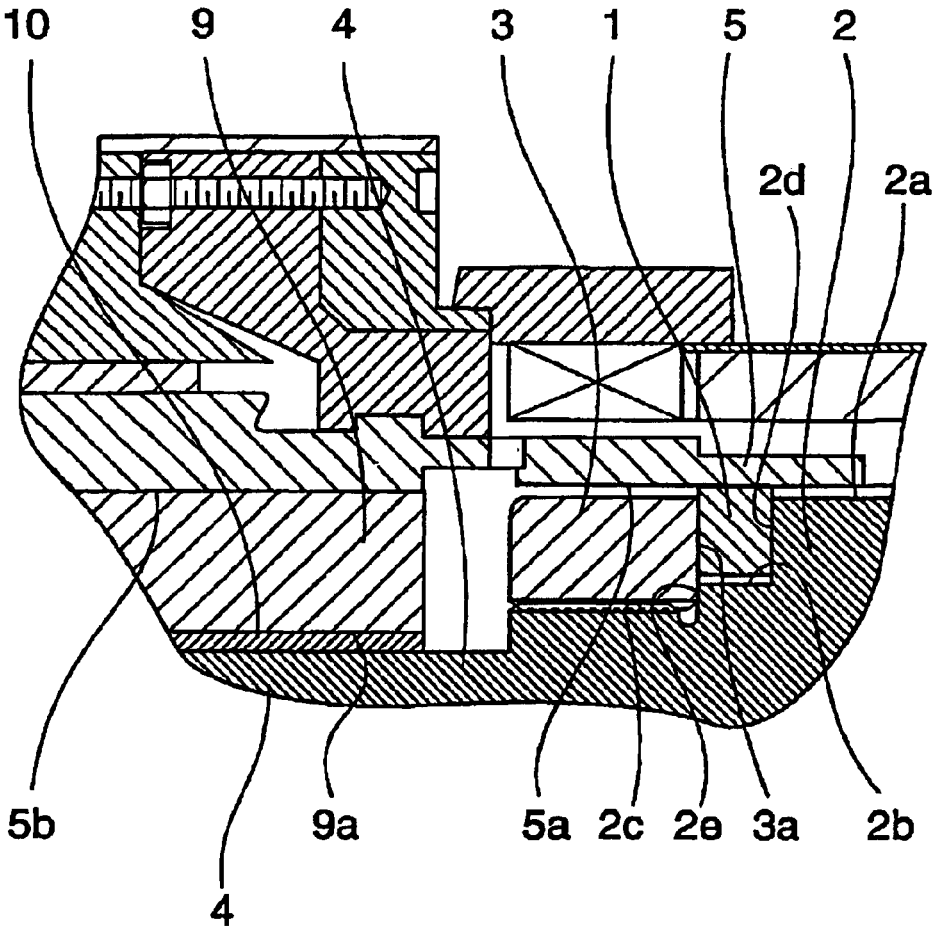
FIG. 3 is a close up cross sectional view of the structure of the displacer and seal assembly for Stirling cycle machines.

Referring to FIGS. 1 to 3, further explanation will be given over the displacer and seal assembly for Stirling cycle machines described in the first aspect of the present invention. The Stirling cycle machines are used as a refrigerating machine in the following explanation. The Stirling cycle machine shown in FIGS. 1, 2 is provided with a displacer 2, a power piston 9, a cylinder 5, either of which is made of aluminum for example, as well as a seal 1 and a retaining ring 3. The displacer 2 and the power piston 9 are structured so as to reciprocate with each other in a phase relationship along the inner peripheral surfaces 5*a* and 5*b* of a cylinder bore concentrically formed in the cylinder 5. The displacer 2 is comprised of a body portion 2*a* that is formed in a cylindrical shape, a first and second steps 2*b*, 2*c*, and a rod 4 concentrically formed with the body portion 2*a* respectively.

The outer periphery of the body portion 2*a* is formed with a diameter that can be inserted into the inner peripheral surface 5*a* of the cylinder with a predetermined radial clearance left therebetween. The first step 2*b* is integrally disposed on one end of the body portion 2*a*, and has a diameter smaller than the outer periphery of the body portion 2*a*. A side surface 2*d* connecting the outer periphery of the first step 2*b* to the outer peripheral end of the body portion 2*a* is formed perpendicularly to the center axis. Further, the second step 2*c* is integrally disposed on one end of the first step 2*b*, and has a diameter smaller than the outer peripheral surface of the first step 2*b*. The rod 4 is integrally disposed on one end of the second step 2*c*, and has a circular cross sectional shape with a diameter smaller than the outer periphery of the second step 2*c*. The top end 4*a* of the rod 4 passes through a center hole 9*a* formed in the center of the power piston 9, and is radially supported by a bearing seal 10 provided in the cylinder hole 9*a*.

The radial clearance between the rod 4 and the bearing seal 10 should be small enough to prevent gas leakage between the spaces in front and the rear of the power piston 9. However, if mass of the displacer 2 is sufficiently small, a simple plastic slide bearing may preferably be employed in which the bearing seal 10 is closely contacted with the rod 4. For example, the bearing seal 10 using a homopolymer acetal resin processed with polytetrafluoroethylene effectively works for the rod 4 made of anodized aluminum. In order to further reduce the friction force, a gas bearing may be employed for the bearing seal 10.

The end portion 4*a* of the rod 4 is supported by the center of a circular spring 21 that is mounted to one end portion of the cylinder 5 by screws 20. One end portion of the power piston 9 is also supported with a similar circular spring. Although the circular spring 21 and the like suitably adjusts a phase difference of the relative reciprocating motions of the power piston 9 and the displacer 2 in an optimum manner, its radial elastic coefficient is small. Accordingly, the displacer 2 is radially supported by the bearing seal 10 provided in the outer periphery of the rod 4 and the center of the power piston 9.

The seal 1 shown in FIG. 3 is formed in a ring shape with an injection molded plastic member or Teflon3-coated aluminum for example, having a rectangular cross sectional shape. The outer periphery of the seal 1 is formed in such a shape for the seal to be closely inserted into the inner peripheral surface 5*b* of the cylinder 5. That is, the radial clearance between the outer periphery of the seal 1 and the inner periphery of the cylinder 5 should be small enough to prevent an excessive gas leakage on one hand and just large enough to avoid any excessive friction forces on the other hand. Normally, the radial clearance is equal to or less than four times as large as the one required between the outer periphery of the power piston 9 and the inner periphery of the cylinder 5 to the maximum. If the Stirling cycle machines is used as an engine, the seal 1 is preferably formed of metal such as stainless, Teflon3-coated aluminum or the like.

The inner periphery of the circular hole in the seal 1 is formed with such a diameter for the seal 1 to radially move while inserted into the outer periphery of the first step 2*b*. That is, the radial clearance between the inner periphery of the circular hole in the seal 1 and the outer periphery of the first step 2*b* is larger than that between the inner peripheral surface 5*a* of the cylinder 5 and the outer periphery of the body portion 2*a*. Accordingly, even if the displacer 2 reciprocates eccentrically enough for the outer periphery of the body portion 2*a* to contact with one side of the inner peripheral surface 5*a* of the cylinder 5, the contact between the outer periphery of the seal 1 and the outer periphery of the body portion 2*a* is maintained and does not suffer from the eccentric motion of the displacer 2. Further, the width of the seal 1 is formed slightly narrower than the axial length of the first step 2*b*.

The second step 2*c* is provided with a male screw on the outer periphery thereof, and the retaining ring 3 formed of plastic members is screwed into the male screw. One end surface 3*a* of the retaining ring 3 is formed perpendicularly to the central axis. The axial position of the retaining ring 3 is defined by a portion where the retaining ring 3 engages with a side surface 2*e* that connects the first step 2*b* and the second step 2*c*. The seal 1 is held between one end surface 3*a* of the retaining ring 3 and the side surface 2*d* of the first step and is inserted onto the outer periphery of the first step 2*b*. As the width of the seal 1 is formed slightly narrower than the axial length of the first step 2*b*, the retaining ring 3 does not apply axial compression forces to the seal 2.

Figure 4:
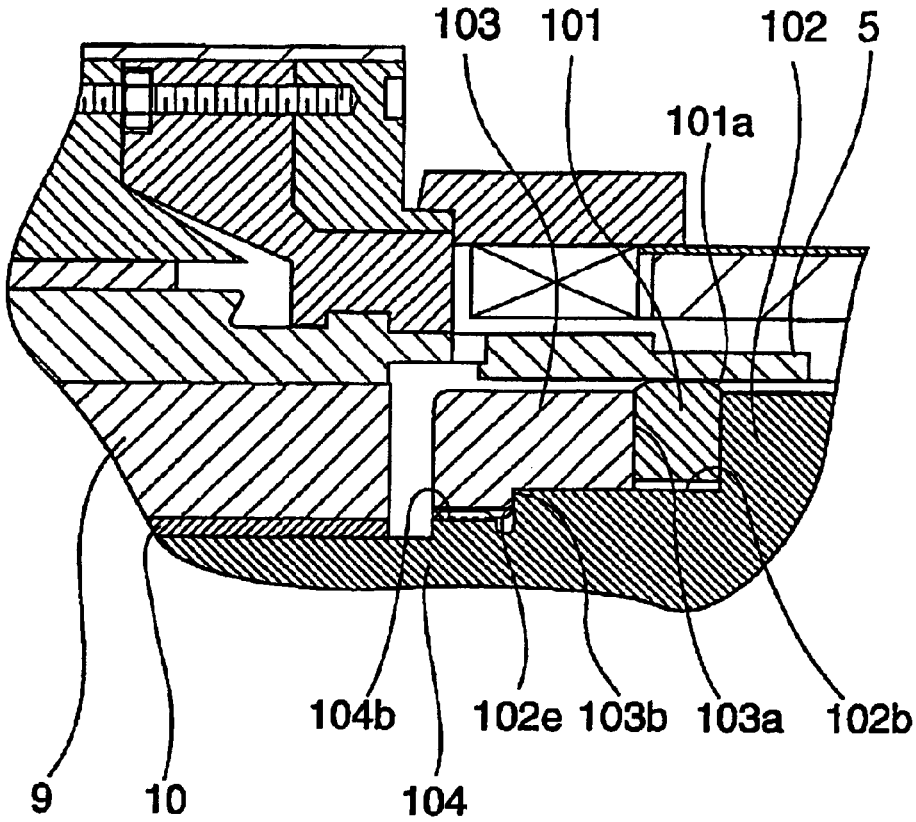
FIG. 4 is a close up cross sectional view of the structure of the displacer and seal assembly for Stirling cycle machines showing the wedge-shaped spaces.

Referring to FIG. 4, another means for defining the axial position of the retaining ring 3 is presented. Reference numerals of relevant portions are differentiated by adding 100 to the reference numerals in FIG. 3. This means does not have the second step 2*c* in FIG. 3. The axial length of the outer periphery of the first step 102*b* in the displacer 102 is longer than the width of the seal 101. The first step 102*b* is provided with a male screw 104*b* having an outer diameter smaller than the outer periphery thereof on one end thereof. The retaining ring 103 has a center hole to be closely inserted into the outer periphery of the first step 102*b* and a female screw engaging with the male screw 104*b*, both of which are formed concentrically with the center axis. Further, the axial width of the seal 101 is provided with such a dimension that the axial compression forces are not applied to the seal 101 when the side surface 103*b* is in contact with the side surface 102*e* of the displacer 102.

Next, referring to FIGS. 1 to 3, the function and effect of the seal 1 will be explained while summarizing the operation of the Stirling cycle machines used as a refrigerator. The Stirling cycle machines is enclosed and sealed with a rear casing 30 and a front casing 31, respectively formed of a sheet metal in a cylindrical shape, and a front cover 32. The enclosed volume of the rear casing 30 and front casing 31 is filled with compressed helium, which serves as a working medium. In FIG. 2, when the power piston 9 moves toward the right by the operation of a linear motor 40, helium gas in a space 11 that is defined by the power piston 9 and the displacer 2 is compressed and the temperature and pressure of the gas increases. The space 11 communicates with a right space 13 defined by the right end surface of the displacer 2 and the front cover 32 through a heat-rejecting exchanger 41, a regenerator 42 and a heat-absorbing exchanger 43, all of which are stored in the front casing 31. Accordingly, the pressure of the gas in the space 13 of the displacer 2 simultaneously increases, and each pressure in the left and right spaces 11, 13 of the displacer becomes roughly equal.

On the other hand, the pressure receiving area of the left side of the displacer 2 is smaller than that of the right side thereof by an amount of the cross sectional area of the rod 4. And the pressure of the sealed gas in the left space 12 of the power piston 9 that is applied to the front end of the rod 4 is lower than that of the compressed gas in the right space 13. Accordingly, due to the small area difference between the pressures respectively applied to the left and the right sides of the displacer 2, the displacer 2 moves toward the left. By which, the compressed gas in the left space 11 of the displacer transfers to the right space 13 of the displacer 2 through the heat-rejecting exchanger 41, regenerator 42 and heat-absorbing exchanger 43. During the transfer, heat of the compressed gas is rejected to the outside by the heat-rejecting exchanger 41 and is absorbed by the heat-absorbing exchanger 42 to be accumulated.

When the power piston 9 moves toward the left by the operation of the linear motor 40, gas in the space 11 that is defined by the right side of the power piston 9 and the left side of the displacer 2 expands. Simultaneously, gas in the right space 13 of the displacer 2 that communicates with the space 11 expands to decrease its temperature and pressure. In this process, contrary to the process previously described, as the pressure force in the right side of the displacer 2 becomes lower than that in the left side due to the cross sectional area of the rod 4, the displacer 2 moves toward the right. Accordingly, the gas in the right space 13 of the displacer 2 transfers to the left space 11 through the heat-absorbing exchanger 43, the regenerator 42 and the heat-rejecting exchanger 41. During the transfer, the passing gas absorbs heat from the outside in the heat-absorbing exchanger 43 and receives accumulated heat in the regenerator 42.

As explained above, the power piston 9 repeats the compression and expansion processes by the linear motor 40 on one hand, the displacer 2 reciprocates in a phase relationship to the power piston due to the difference of pressure forces applied to the opposite cross sectional areas of the displacer 2 on the other hand. The compressed gas and depressed gas alternately flows through the heat-rejecting exchanger 41, the regenerator 42 and the heat-absorbing exchanger 43 by the reciprocating motion of the displacer 2, to discharge heat to the outside in the heat-rejecting exchanger 41 and to absorb heat from the outside in the heat-absorbing exchanger 43, by which an exterior freezer is workable. During the operation, heat of the gas is stored after the regenerator 42 in the compression process on one hand, the stored heat is recovered into the gas after the expansion process on the other hand. Accordingly, coefficient of the operating performance of the refrigerator is increased.

As explained above, in the Stirling cycle machines, the respective pressures in the left and right spaces 11, 13 are roughly equal, and the displacer 2 reciprocates due to the difference of pressure force applied to either side of the displacer 2. Under the circumstance, the seal 1 has the following functions and effects. The seal 1 is disposed on the first step 2*b* and is axially located between the retaining ring 3 and the side surface 2*d* of the first step 2*b*. However, as the seal 1 is slightly narrower in width than the axial length of the outer periphery of the first step 2*b*, it does not receive axial compression forces. On the other hand, the end surface of the retaining ring 3 and the side surface 2*d* of the first step 2*b* are disposed perpendicularly to the axial direction. Accordingly, when pressures in the right and left sides of the displacer 2 transitionally change, one of the side surfaces of the seal 1 is pushed closely to one of the vertical surfaces due to the pressure difference, by which gas leakage from the side surfaces of the seal can be prevented.

Further, although the outer periphery of the seal 1 is formed so as to be closely contacted with the inner peripheral surface 5*a* of the cylinder 5, it is not pressed against the inner peripheral surface of the cylinder as the split seal ring. Accordingly, when the outer periphery of the seal 1 is formed so as to have a diameter closely contacted with the inner peripheral surface 5*a* of the cylinder 5, friction forces against the cylinder can be significantly small and friction wear can be minimized. On the other hand, as the respective pressures in the front and rear spaces 11, 13 of the displacer 2 are, as previously explained, substantially equal, gas leakage from the slight clearance between the outer periphery of the seal 1 and the inner periphery 5*a* of the cylinder 5 is restricted to the minimum.

Further, the radial clearance between the inner periphery of the circular hole in the seal 1 and the outer periphery of the first step 2*b* is made larger than the estimated maximum radial clearance between the inner peripheral surface 5*a* of the cylinder 5 and the outer periphery of the body portion 2*a*. On the other hand, the displacer 2 itself is radially supported by the rod 4 and the bearing seal 10 provided in the through hole of the power piston 9. Accordingly, when the clearance between the inner peripheral surface 5*a* of the cylinder 5 and the outer periphery of the body portion 2*a* is set large to some extent, the outer periphery of the seal 1 is closely contacted with the inner periphery of the cylinder by the radial movement of the seal 1, even in the case that either the straightness or concentricity between the rod 4 and the body portion 2*a* or that of the bearing seal 10 more or less deviates and the outer periphery of the body portion 2*a* shifts to one side of the inner peripheral surface of the cylinder 5.

As shown in FIG. 4, the outer periphery of the seal 101 is formed so that it is in axially parallel at the center portion of the seal 1 and so that the radius of the seal 1 gradually decreases from the either edge of the center portion of the seal 1 toward the either side surface thereof. Accordingly, wedge-shaped spaces 101*a* between the outer periphery of the seal 101 and the inner peripheral surface 5*a* of said cylinder 5 are formed.

For the design of the wedge-shaped spaces 101*a*, a theoretical computing means is available, which is disclosed under the title: "Gas Lubrication of a Ringless Piston in an Internal Combustion Engine under Dynamic Loading" by Z. P. Mourelatos in ASME Paper No. 88-Trib-26, developed on the theoretical and experimental basis.

When the seal 101 is formed in that shape, gas is pressed into the wedge-shaped spaces 101*a* at both ends of the outer periphery of the seal 101 during the high-speed reciprocating motion of the displacer 2. By which, the outer periphery of the seal 101 detaches itself from the inner peripheral surface 5*a* of the cylinder 5 in a state like "floating in the gas" due to the gas pressure. Accordingly, mechanical contacts between the seal 1 and the cylinder 5 are eliminated, and the friction forces decrease to almost zero.

What is claimed is:

1. A displacer and seal assembly for Stirling cycle machines comprising:

a displacer (2), a power piston (9), a cylinder (5), a seal (1) and a retaining ring (3);

said displacer (2) and said power piston (9) structured so as to reciprocate with each other in a phase relationship along the inner peripheral surfaces (5*a*, 5*b*) of a cylinder bore formed concentrically with said cylinder (5);

said displacer (2) comprising a cylindrical body portion (2*a*), and a step (2*b*) and a rod (4), both of which are provided concentrically with said body portion (2*a*);

the outer periphery of said body portion (2*a*) having a diameter to be inserted into the inner peripheral surface (5*a*) of said cylinder (5) with a predetermined radial clearance;

said step (2*b*) integrally disposed on one end of said body portion (2*a*) and having a diameter smaller than the outer periphery of said body portion;

a side surface (2*d*), which connects the outer periphery of said step (2*b*) to the outer peripheral end of said body portion (2*a*), formed perpendicularly to the axial direction;

said rod (4) integrally disposed on one end of said step (2*b*) and having a circular cross sectional shape;

said seal (1) formed in a ring shape and having a circular hole in the center thereof;

the outer periphery of said seal (1) having a diameter to be closely inserted into the inner peripheral surface (5*a*) of said cylinder (5);

the inner periphery of the circular hole in said seal (1) having a diameter to be attached to the outer periphery of said step (2*b*) with a predetermined radial clearance;

said retaining ring (3) formed in a cylindrical shape and having a through hole in the center thereof;

the outer periphery of said retaining ring (3) formed so as to have the same diameter as the outer periphery of said body portion (2*a*);

one end surface (3*a*) of said retaining ring (3) formed perpendicularly to the axial direction;

said rod (4) passing through a center hole (9*a*) that is formed in the center of said power piston (9) and radially supported by a bearing seal (10) that is provided in said center hole (9*a*);

said seal (1) inserted on the outer periphery of said step (2*b*);

said retaining ring (3) installed in a position at which no axial pressure is applied to said seal (1) that is inserted on the step (2*b*);

wherein said seal (1) is structured to freely move in the radial direction thereof between said one end surface (3*a*) of said retaining ring (3) and said side surface (2*d*) of said step (2*b*).

2. A displacer and seal assembly for Stirling cycle machines in claim 1, wherein the outer periphery of said seal (101) is formed so as to have an axially parallel portion in the center of axial length of said seal (101) and so as to have axially slope portions in which the radius gradually decreases from the either edge of said parallel portion toward the either side surface of said seal (101), to form wedge-shaped spaces (101*a*) between said respective axially slope portions and the inner peripheral surface (5*a*) of said cylinder (5).

* * * * *